United States Patent [19]

McKay et al.

[11] Patent Number: 4,639,236

[45] Date of Patent: Jan. 27, 1987

[54] TOY VEHICLE AND LAUNCHER

[75] Inventors: Robert S. McKay, 7420 Beckwith Rd., Morton Grove, Ill. 60053; Dennis R. Dahm, Streamwood, Ill:

[73] Assignee: Robert S. McKay, Wood Dale, Ill.

[21] Appl. No.: 699,591

[22] Filed: Feb. 8, 1985

[51] Int. Cl.[4] ..... A63H 29/00

[52] U.S. Cl. ..... 446/430

[58] Field of Search ..... 446/430, 429, 399, 400, 446/435, 63, 64, 65, 457, 454

[56] References Cited

U.S. PATENT DOCUMENTS

| | | | |
|---|---|---|---|
| 2,517,084 | 8/1950 | Carver | 446/430 |
| 2,627,853 | 2/1953 | Koepnick | 446/429 |
| 3,392,484 | 7/1968 | Ryan et al. | 446/435 |
| 4,155,194 | 5/1979 | Amamoto et al. | 446/65 |
| 4,345,402 | 8/1982 | Hanson et al. | 446/430 |
| 4,413,443 | 11/1983 | Kulesza et al. | 446/430 |
| 4,443,966 | 4/1984 | Birdsall | 446/430 |
| 4,501,567 | 2/1985 | Cathell | 446/430 |

*Primary Examiner*—Mickey Yu

*Attorney, Agent, or Firm*—Robert V. Jambor

[57] ABSTRACT

A toy formed as a small vehicle which is propelled from a simulated explosive such as dynamite. The simulated dynamite is inserted in the rear of the toy. The toy vehicle is released from the simulated explosive by a cable attached to a plunger type detonator. The insertion of the simulated dynamite into the vehicle compresses a spring which drives the vehicle away from the simulated dynamite on actuation of a release mechanism.

9 Claims, 13 Drawing Figures

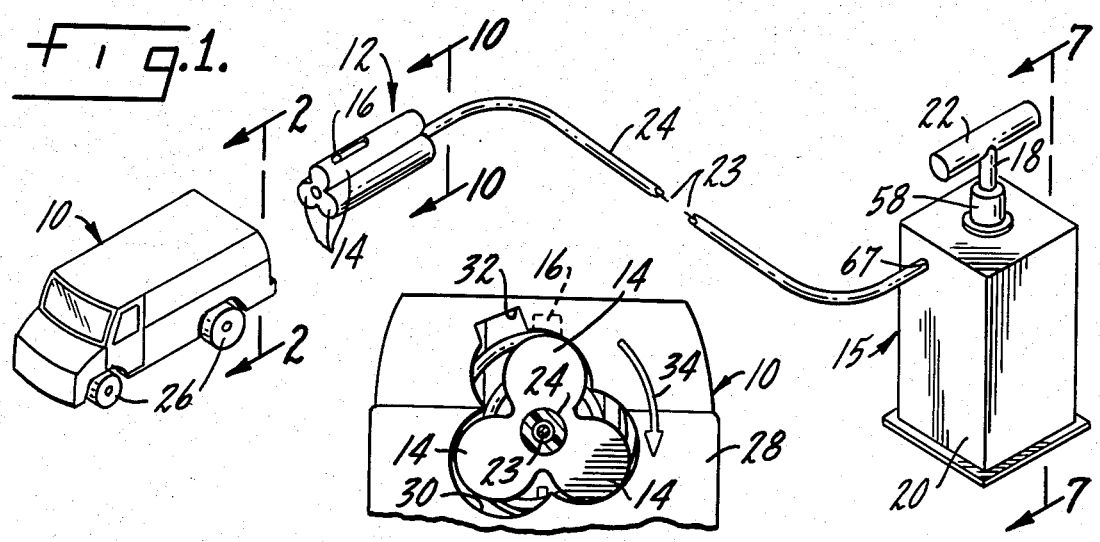
Fig. 1.
Fig. 3.
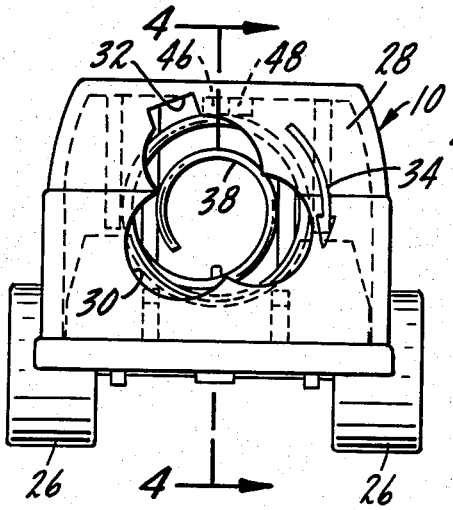
Fig. 2.
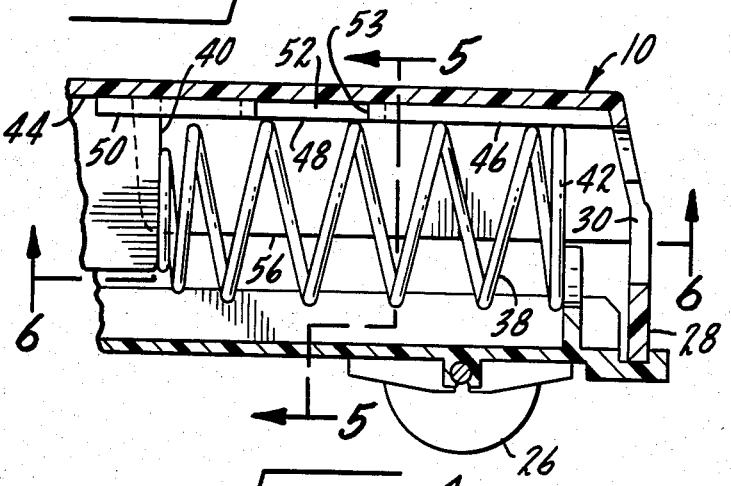
Fig. 4.
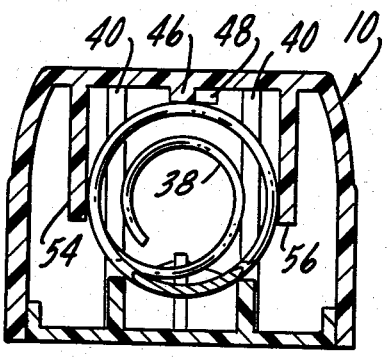
Fig. 5.
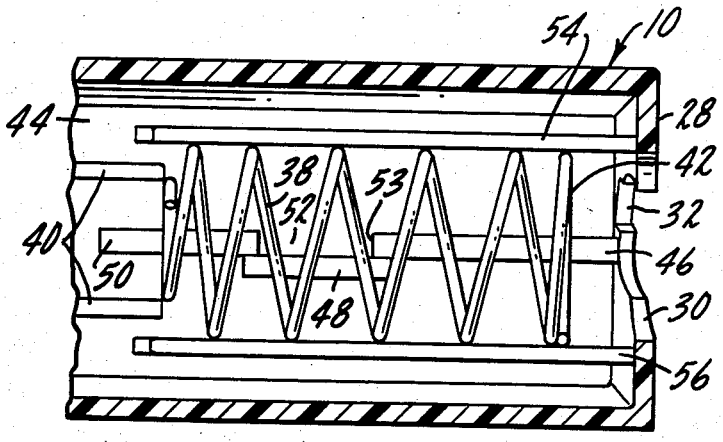
Fig. 6.

Fig. 7.
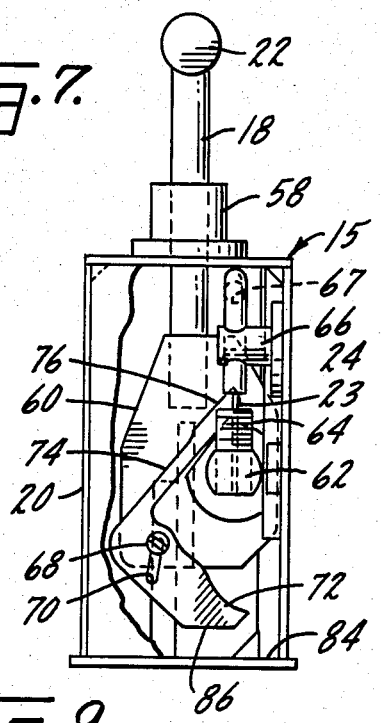
Fig. 8.
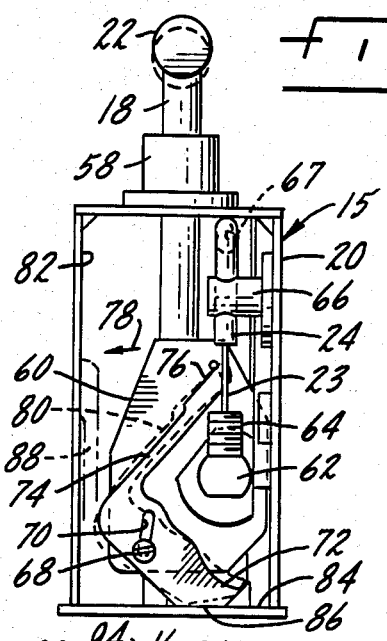
Fig. 9.
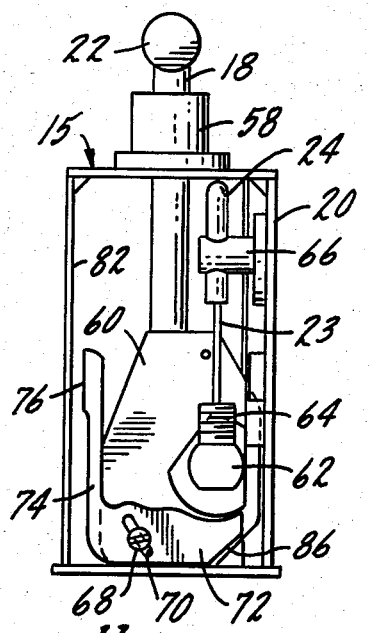
Fig. 11.
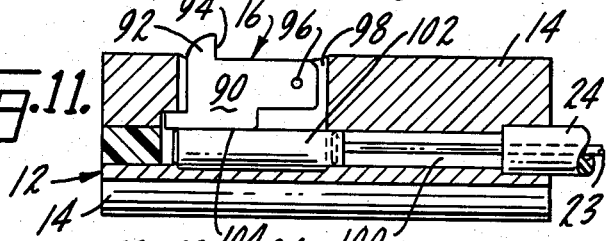
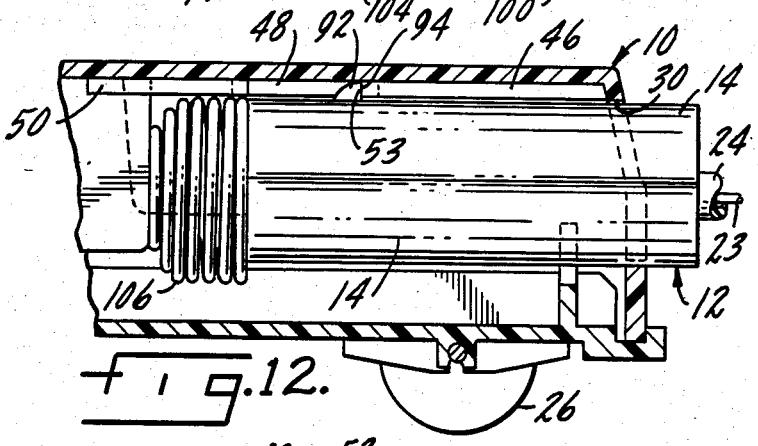
Fig. 12.
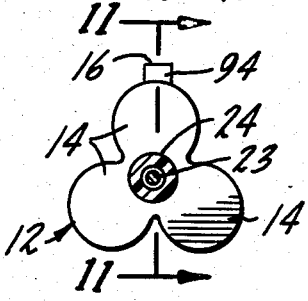
Fig. 10.
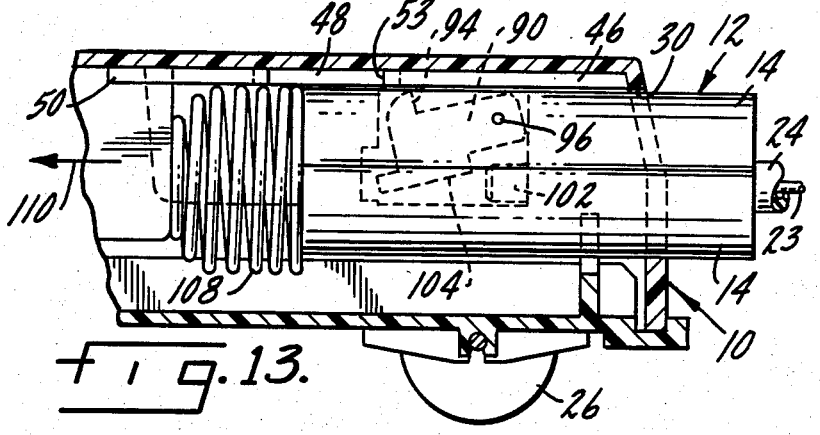
Fig. 13.

TOY VEHICLE AND LAUNCHER

BACKGROUND OF THE INVENTION

This invention relates to a toy in general and in specific to a novel toy into which a simulated explosive charge is placed to propel the toy from the charge.

It is known in the art of toy design to provide various simulated events which stimulate the imagination of the user. Such would include simulated rocket launchers for example, or simulated guns which make noise or flash light. It would also include, for example, toy planes or autos which separate into pieces under simulated crash conditions. The present invention adds a different dimension to simulated or imaginary activity in that it creates the fanciful impression that the vehicle is being blasted on its way by an explosive charge.

SUMMARY OF THE INVENTION

The present invention encompasses a toy which comprises a vehicle and a vehicle launcher which takes the form of a simulated explosive charge. The vehicle is propelled by activation of the simulated explosive.

The vehicle includes a propulsion spring which is set by insertion of the simulated explosive into the vehicle. The launcher includes means to release the vehicle from the charge and means to actuate the release means. The relative weights of the vehicle and simulated charge are such that the vehicle is propelled relative to the charge on release of the spring.

The launcher may also include a noisemaker positioned to make a loud noise upon release of the vehicle to further simulate an explosion.

DESCRIPTION OF THE DRAWINGS

FIG. 1 is a perspective view of a novel toy illustrative of the invention and including a vehicle and launcher in the form of a simulated explosive charge and detonator.

FIG. 2 is a rear view, taken along line 2—2 of FIG. 1 showing the rear of the vehicle which receives the simulated explosive.

FIG. 3 is a partial rear view, similar to the view shown in FIG. 2 showing the explosive positioned within the toy and engaged prior to activation of release means.

FIG. 4 is a cross-sectional view, taken along line 4—4 of FIG. 2 showing in detail a propulsion spring contained within the toy.

FIG. 5 is a cross-sectional view, taken along line 5—5 of FIG. 4, showing in detail the spring in the vehicle.

FIG. 6 is a cross-sectional view, taken along line 6—6 of FIG. 4 showing the underside of the internal portion of the vehicle and showing in greater detail the means for engaging the simulated explosive positioned within the vehicle.

FIG. 7 is a side view, partially broken away and viewed along line 7—7 of FIG. 1, showing in detail the internal construction of a portion of the launcher.

FIG. 8 is a side view, similar to the view shown in FIG. 7 partially disassembled, showing the actuator means positioned in an activated position and showing a noisemaker contained within the actuator means.

FIG. 9 is a further side view, similar to the view shown in FIG. 7 partially disassembled, showing the actuator means totally activated and showing the final position of the noisemaker used to simulate an explosion.

FIG. 10 is a cross-sectional view, taken along line 10—10 of FIG. 1 showing in greater detail the construction of the explosive in the form of a plurality of simulated dynamite sticks.

FIG. 11 is a cross-sectional view, taken along 11—11 of FIG. 10 showing in greater detail the release means, particularly as intended for releasing the engagement of the explosive from the toy vehicle.

FIG. 12 is a cross-sectional view of the toy similar to the view shown in FIG. 4 and showing the spring compressed by the insertion of the simulated explosive and further showing the engagement of the release means with the toy to hold the explosive within the toy.

FIG. 13 is a cross-sectional view of the toy similar to the view shown in FIG. 12 and showing, in dashed lines, the release of the latch means from the engagement means to allow the toy to be propelled away from the simulated explosive.

DETAILED DESCRIPTION

Referring now to the drawings in general and in particular to FIG. 1 of the drawing there is shown a perspective of the new and novel toy which comprises a vehicle 10 in the form of a truck and a launcher generally designated by the numeral 12. The launcher includes a plurality of simulated dynamite sticks 14 and actuator means in the form of a detonator 15. Dynamite 14 contains release means 16 for releasing the engagement between the truck 10 and dynamite 14.

Detonator 15 includes plunger 18 contained within a plunger case 20 and is activated by a handle 22. A cable wire 23 is contained within the cable cover 24 connected to the dynamite sticks 14 to release the release means 16 upon activation of the plunger 18. When this occurs the vehicle 10 will be propelled away from the dynamite sticks 14 rolling on the wheels 26. Of course, other forms of the vehicle 10 and launcher 12 are within the spirit and scope of the invention.

Referring now to FIG. 2 of the drawing there is shown a rear view, taken along line 2—2 of FIG. 1 showing the back of the truck 28 containing an opening 30 formed in the configuration of the dynamite sticks 14. A slot 32 is also contained in the opening 30 to allow the release means 16 to enter the truck. An arrow 34 is formed on the back of the truck 28 to show the direction that the dynamite sticks 14 should be turned upon insertion into the truck.

Referring now to FIG. 3 of the drawing there is shown a partial rear view of the truck similar to the view shown in FIG. 2 and showing the simulated dynamite sticks 14 which have been inserted into the opening 30 and have been turned in the direction shown by the arrow 34 so that the release means 16 is engaged on the interior of the truck as will be described more fully hereinafter.

Referring now to FIG. 4 of the drawing there is shown a cross-sectional view, taken along line 4—4 of FIG. 2 showing an internal compression spring 38 positioned within the vehicle 10 with the one end of the spring 38 positioned against movement by a series of ribs 40. The other end 42 of the compression spring 38 is free to move toward and away from ribs 40. The dynamite sticks 14 compress the spring 38 upon insertion of the dynamite sticks into the vehicle 10.

Referring now to FIG. 5 of the drawing there is shown a cross-sectional view, taken along line 5—5 of FIG. 4 showing in greater detail the internally formed ribs 40 and also showing the ribs 54 and 56 downwardly positioned from the roof of the truck to contain the spring 38.

Referring now to FIG. 6 of the drawing, there is shown a cross-sectional view, taken along line 6—6 of FIG. 4 showing in greater detail the positioning of the ribs 54 and 56 used for containing the spring 38 within the vehicle and also showing in greater detail the positioning of the ribs 40. Also contained on the underside 44 of the vehicle roof is a series of ribs 46, 48 and 50 formed on the underside of the roof 44 and positioned as shown in FIG. 6. A rib opening 52 is provided by the positioning of the ribs 46, 48 and 50 and is designed to receive the release means 16. The release means 16 engages the lip surface 53 of the rib 46 whenever the dynamite sticks 14 are inserted through the opening 30 and turned in the direction shown by the arrow 34. The ribs 46, 48 and 50 in combination with the rib opening 52 and the lip surface 53 serve as the engaging means for engaging the release means 16 contained on the dynamite sticks 14.

Referring now to FIG. 7 there is shown a cross-sectional view, taken through line 7—7 of FIG. 1 of the plunger case 20 showing interior construction of the actuator means in the form of a simulated dynamite plunger. As has been described, a plunger 18 is connected to a plunger handle 22 and is positioned within the sleeve 58 formed on top of the plunger case 20. A plate 60 is fixedly attached to the plunger 18 and is arranged to move upwardly and downwardly in a series of tracks, not numbered in the drawing. A member 62 is formed on the plate 60 and carries a screw 64 into which is positioned the cable wire 23 contained within the cable cover 24. The cable 24 is positioned through the cover opening 67 shown in FIG. 1 of the drawing and into the cover holder 66 which holds the cable cover tight so that the cable wire 23 may be positioned within the screw 64. In this manner the cable wire 23 will be activated by the upward or downward motion of the plate 64 attached to the plunger 18.

A screw 68 is positioned within an elongated slot 70 of the noisemaker 72 and is screwed into a drilled and tapped hole, not shown in the drawing, in the plate 60. The noisemaker 72 is formed in a generally L-shaped configuration and has an upper arm 74 containing an upper surface 76. The noisemaker 72 is designed to pivot in the direction shown by the arrow 78 shown in FIG. 8 of the drawing to strike the inside of the case 82 to cause a loud noise simulating the explosion of the dynamite sticks.

Referring now to FIG. 8 of the drawing there is shown a cross-sectional view similar to the view shown in FIG. 7 showing the plunger 18 moving in a downward position and showing how the noisemaker 72 will be pivoted about the screw 68 contained in the slot 70 as the bottom surface 86 of the noisemaker strikes the inside surface 84 of the base of the plunger case 20. When this occurs, the arm 74 will pivot in the direction shown by the dashed lines 80 to the final resting place shown by the dashed lines 88 striking the inside of the case 82 to cause the loud noise.

The final position of the plunger 18 is shown in FIG. 9 of the drawing where it can be seen how the noisemaker 72 has been repositioned so that the arm 74 is vertical with its upper surface 76 resting on the inside of the case 82. When so positioned, it can also be seen in FIG. 9 that the downwardly extension of the plate 60 will cause the member 62 and the screw 64 to pull the cable wire 23 through the cable cover 24 to activate the release means 16 shown in FIG. 1 and also shown in greater detail in FIGS. 11 through 13 of the drawings.

Referring now to FIG. 10 there is shown a cross-sectional view taken through line 10—10 of FIG. 1 showing in detail the construction of the simulated dynamite sticks 14 which are fastened to the cable wire 23 contained within the cable cover 24. It can be seen in FIG. 10 also the release means 16 and how it protrudes from the top of the pile of simulated dynamite sticks 14.

Referring now to FIG. 11 there is shown a cross-sectional view, taken through line 11—11 of FIG. 10 showing in greater detail the interior construction of the release means 16 which comprises in part a pivoted hook-shaped member 90 having a hook portion 92 and containing a surface 94 for engaging with the surface 53 formed on the rib 46 of FIG. 6. The hook-shaped portion 90 is pivoted on a pin 96 contained within the opening 98 in the upper dynamite stick 14. A second opening 100 formed in the dynamite sticks 14 contains a movable cylinder 102 that is fixedly attached to the cable wire 23. Upon an activation of the plunger 18, as has been before described, the movement of the plunger 18 and the plate 60, as shown in FIG. 9, will move the cable wire 23 within the cable cover 24 to slide the cylinder 102 in the cylinder opening 100. The bottom surface 104 of the hook-shaped member 90 rides on the cylinder 102 and upon a withdrawal of the cylinder 102 by movement of the cable wire 23, the hook-shaped member 90 will pivot at pin 96 to release the dynamite sticks 14 from engagement with the truck as will be described more fully hereinafter. The disengagement position of the hook-shaped member 90 is shown in FIG. 13 of the drawing by the dashed lines which show the cylinder 102 having been moved along the cylinder opening 100 by a movement of the wire 23 activated by the plunger 18.

Referring now to FIGS. 12 and 13 it can be seen that the dynamite sticks 14 have been inserted into the truck 10 to compress the spring which is now shown by the numeral 106 in the compressed state. The release means 16 in the form of the hook portion 92 has its surface 94 engaging the surface 53 of the rib 46 which has been described when referring to FIG. 6. When in this position shown in FIG. 12, the truck 10 and the simulated dynamite sticks 14 are in a position ready for disengagement by activation of the plunger 18 as hereinbefore described.

Referring to FIG. 13 there is shown the disengagement whenever the compressed spring starts to expand as shown by the numeral 108 to propel the truck 10 in the direction shown by the arrow 110. This occurs because the weight of the truck 10 is less than the weight of the dynamite sticks 14. From experimentation it has been found that an acceptable weight for a truck 10 which is about one and one half inches long and three quarters of an inch high would be approximately three quarters of an ounce when compared to the weight of dynamite sticks 14 two inches long which would be approximately one-and-one-half ounces. Generally the weight of the simulated explosive should be about twice the weight of the vehicle. As a result the heavier weight of the dynamite sticks 14 serves as a base to allow the spring to force the truck 10 away from the dynamite sticks.

The truck, for example, could be formed of molded plastic. The dynamite sticks could be die cast metal. The release of the release means 16 as shown in FIG. 13 caused by the activation of the wire 23 to withdraw the cylinder 102 in the opening 100 causes the hook-shaped member 90 to pivot to the position shown in FIG. 13 in the dashed lines. When this occurs this surface 94 on the hook portion 92 disengages from the surface 53 on the rib 46 formed in the roof of the truck. Simultaneously with this occurring, as has been before described, the noisemaker 72 hits or slaps against the inside 82 of the plunger case 20 to simulate the dynamite sticks exploding. The vehicle 10 will then be forced rapidly away from the dynamite sticks 14.

The predetermined heavier weight of the dynamite sticks is sufficient when compared with the lighter weight of the truck 10 to cause the bias force of the spring 38 to force the vehicle away from the dynamite sticks 14 as the spring returns to its uncompressed state upon an actuation of the release means 16 through plunger 18. In the preferred embodiment, the vehicle may be a truck 10 and may also be other types of vehicles within the spirit and scope of the invention.

It will be apparent to those skilled in the art that various additions, substitutions, modifications and omissions may be made to the construction of the present toy without departing from the spirit or scope of the invention. Thus, it is intended that the present invention cover the additions, substitutions, modifications and omissions of this invention which come within the permissible scope of the appended claims.

We claim:

1. A toy comprising:

(a) a toy vehicle having formed therein an opening at the rear of the vehicle;

(1) a spring positioned within the vehicle and compressible therein;

(b) a launcher comprising a weighted group of simulated dynamite sticks, sized to be received within said opening in said vehicle, the group containing release means for releasable engagement with said vehicle;

(c) actuator means for actuating the release means to engage and hold the group of dynamite sticks within the vehicle and to hold the spring in a compressed position, and to release the same and permit said spring to return to its uncompressed condition;

(d) wherein said launcher and actuator means are spaced apart and are connected only by an actuator cable adapted to cause said release means to release said vehicle from said launcher on actuation of said release means.

2. The toy as defined in claim 1, said actuator means being in the form of a simulated detonator for said dynamite and having a depressable plunger and further comprising a noisemaker positioned within the detonator and being activated by the plunger to make a loud noise simulating an explosion of the dynamite sticks upon a downward motion of the plunger.

3. The toy as defined in claim 2, said detonator having an outer case, and further comprising the noisemaker being formed in a generally L-shaped configuration and being pivotably mounted on the plunger and designed to strike the inside of the case to make the loud noise as the plunger is moved downwardly.

4. The toy as defined in claim 1 wherein release means comprises in part a pivoted hook-shaped member positioned partially inside the dynamite sticks with a hook portion being exposed on the outside of the dynamite sticks for engagement with engaging means on said vehicle.

5. The toy as defined in claim 1 further comprising the toy vehicle being formed as a wheeled truck.

6. The toy as defined in claim 5 wherein the group of dynamite sticks are three and the opening at the rear of the truck is shaped to receive the three dynamite sticks and also to receive the hook portion.

7. The toy as defined in claim 6 wherein the engaging means comprises a plurality of ribs being formed in the toy vehicle, the ribs being positioned to form an opening for positioning of the hook portion in the opening.

8. The toy as defined in claim 7 further comprising the release means comprising in part a cylindrical member attached to the cable and positioned in an opening within the dynamite sticks, the hook-shaped member being positioned on top of the cylindrical member and being pivoted so that upon a predetermined movement of the cylindrical member the hook-shaped member will pivot downwardly to release the hook portion from the engaging means opening formed in the ribs.

9. The toy as defined in claim 1 wherein the predetermined weight of the dynamite sticks is approximately twice the weight of the vehicle.

* * * * *